United States Patent [19]

Mitchell

[11] Patent Number: 4,717,542

[45] Date of Patent: Jan. 5, 1988

[54] INHIBITING CORROSION OF IRON BASE METALS

[75] Inventor: Wayne A. Mitchell, Crystal Lake, Ill.

[73] Assignee: W. R. Grace & Co., New York, N.Y.

[21] Appl. No.: 6,393

[22] Filed: Jan. 23, 1987

[51] Int. Cl.[4] ..... C23F 11/16

[52] U.S. Cl. ..... 422/15; 422/13; 210/699; 252/389.23; 252/180

[58] Field of Search ..... 252/389.23, 180; 210/699; 422/15, 13

[56] References Cited

U.S. PATENT DOCUMENTS

| | | |
|---|---|---|
| 3,116,248 | 12/1963 | Frew . |
| 3,116,249 | 12/1963 | Ratner et al. . |
| 3,578,589 | 5/1971 | Hwa et al. . |
| 3,666,404 | 5/1972 | Hwa et al. . |
| 3,692,673 | 9/1972 | Hoke . |
| 3,709,815 | 1/1973 | Boothe et al. . |
| 3,709,816 | 1/1973 | Walker et al. . |
| 3,772,142 | 11/1973 | Doggett et al. . |
| 3,803,047 | 4/1974 | Hwa . |
| 3,806,367 | 4/1974 | Lange et al. . |
| 3,898,037 | 8/1975 | Lange et al. . |
| 3,928,196 | 12/1975 | Persinski et al. . |
| 3,941,562 | 3/1976 | Hollingshad . |
| 3,959,167 | 5/1976 | Hwa et al. . |
| 4,015,991 | 4/1977 | Persinski et al. . |
| 4,026,815 | 5/1977 | Kallfass et al. . |
| 4,048,066 | 9/1977 | Cuisia et al. . |
| 4,052,160 | 10/1977 | Cook et al. . |
| 4,085,134 | 4/1978 | Redmore et al. . |
| 4,105,581 | 8/1978 | Sexsmith . |
| 4,118,318 | 10/1978 | Welder et al. . |
| 4,126,549 | 11/1978 | Jones et al. . |
| 4,147,681 | 4/1979 | Lim et al. . |
| 4,163,733 | 8/1979 | Buckman et al. . |
| 4,212,734 | 7/1980 | Redmore et al. . |
| 4,229,294 | 10/1980 | Redmore et al. . |
| 4,242,242 | 12/1980 | Allen . |
| 4,255,259 | 3/1981 | Hwa et al. . |
| 4,297,237 | 10/1981 | Boffardi . |
| 4,303,568 | 12/1981 | May et al. . |
| 4,372,870 | 2/1983 | Snyder et al. . |
| 4,432,879 | 2/1984 | Greaves et al. . |
| 4,536,292 | 8/1985 | Matz . |
| 4,552,665 | 11/1985 | Ralston et al. . |
| 4,588,519 | 5/1986 | Kuhn . |
| 4,640,793 | 2/1987 | Persinski et al. ..... 252/180 X |
| 4,649,025 | 3/1987 | Hwa et al. . |
| 4,650,591 | 3/1987 | Boothe et al. ..... 422/15 X |
| 4,663,053 | 5/1987 | Geiger ..... 422/15 X |

FOREIGN PATENT DOCUMENTS

| | | | |
|---|---|---|---|
| 2265873 | 10/1975 | France | 252/389.52 |
| 2061249A | 5/1981 | United Kingdom | 252/389.23 |
| 2105319A | 3/1983 | United Kingdom | 422/16 |
| 2112370A | 7/1983 | United Kingdom | 422/15 |
| 2082600B | 3/1984 | United Kingdom | 526/287 |
| 2087862B | 8/1984 | United Kingdom | 210/701 |
| 2168359A | 6/1986 | United Kingdom | 422/15 |

OTHER PUBLICATIONS

*Betz Handbook of Industrial Water Conditioning,* 8th Edition, (1980), pp. 207 and 208.

*Research Disclosure,* 23229; Ciba-Geigy PLC, p. 278 (Aug. 1983).

*Primary Examiner*—Matthew A. Thexton

*Attorney, Agent, or Firm*—David E. Heiser

[57] ABSTRACT

A process and composition using hydroxyphosphonoacetic acid or its water-soluble salts in combination with certain copolymers, such as water-soluble 1-acrylamido-2-methylpropane sulfonic acid copolymers with acrylic acid or methacrylic acid, provide improved corrosion protection for iron based metal in contact with the system water of aqueous systems.

20 Claims, No Drawings

INHIBITING CORROSION OF IRON BASE METALS

FIELD OF THE INVENTION

The present invention relates to the inhibiting and preventing corrosion of iron based metals which are in contact with aqueous systems, such as cooling water systems.

BACKGROUND OF THE INVENTION

Iron and iron metal containing alloys such as mild steel are well-known materials used in constructing the apparatus of aqueous systems in which system water circulates, contacts the iron based metal surface, and may be concentrated, such as by evaporation of a portion of the water from the system. Even though such metals are readily subject to corrosion in such environments, they are used over other metals due to the strength they have.

It is known that various materials which are naturally or synthetically occurring in the aqueous systems, especially systems using water derived from natural resources such as seawater, rivers, lakes and the like, attack iron based metals (the term "iron based metals" shall mean in the present disclosure and the appended claims iron metal and metal alloys containing iron therein, i.e. ferrous metals). Typical devices in which the iron metal parts are subject to corrosion include evaporators, single and multi-pass heat exchangers, cooling towers, and associated equipment and the like. As the system water passes through or over the device, a portion of the system water evaporates causing a concentration of the dissolved materials contained in the system. These materials approach and reach a concentration at which they may cause severe pitting and corrosion which eventually requires replacement of the metal parts. Various corrosion inhibitors have been previously used.

Chromates and inorganic polyphosphates have been used in the past to inhibit the corrosion of metals which is experienced when the metals are brought into contact with water. The chromates, though effective, are highly toxic and, consequently, present handling and disposal problems. The polyphosphates are relatively non-toxic, but tend to hydrolyze to form orthophosphate which in turn can create scale and sludge problems in aqueous systems. Moreover, where there is concern over eutrophication of receiving waters, excess phosphate compounds can provide disposal problems as nutrient sources. Borates, nitrates, and nitrites have also been used for corrosion inhibition. These too can serve as nutrients in low concentrations, and represent potential health concerns at high concentrations.

Much recent research has concerned development of organic corrosion inhibitors which can reduce reliance on the traditional inorganic inhibitors. Among the organic inhibitors successfully employed are numerous organic phosphonates. These compounds may generally be used without detrimental interference from other conventional water treatment additives. U.K. patent application No. 2,112,370A describes inhibiting metallic corrosion, especially corrosion of ferrous metals, by using hydroxyphosphonoacetic acid (HPAA). The HPAA can be used alone or in conjunction with other compounds known to be useful in the treatment of aqueous systems, including various polymers and copolymers.

Polymeric agents have been used for various purposes in water treatment. U.S. Pat. No. 3,709,815 describes use of certain polymers containing 2-acrylamido-2-methylpropane sulfonic acid (2-AMPSA) for boiler water treatment. U.S. Pat. No. 3,928,196 describes a method of inhibiting scale formation in aqueous systems using certain copolymers of 2-acrylamido-2-methylpropyl sulfonic acid and acrylic acid. U.S. Pat. No. 4,588,517 discloses use of copolymers formed from acrylic acid or methacrylic acid derivatives in combination with 2-acrylamido-2-methylpropane sulfonic acid derivatives to increase corrosion inhibition achieved by phosphates.

SUMMARY OF THE INVENTION

We have found that, although copolymers of 2-acrylamido-2-methylpropane sulfonic acid and an acrylate may themselves fail to achieve significant corrosion inhibition, they can nevertheless be used to substantially reduce the amount of hydroxyphosphonoacetic acid needed to inhibit corrosion of ferrous metals in aqueous systems.

It is an object of this invention to provide a composition and a method capable of being easily worked which substantially inhibits the corrosion of iron based metals.

It is another object of this invention to provide an environmentally non-toxic corrosion inhibitor.

It is yet another object of this invention to provide a composition capable of substantially inhibiting corrosion of ferrous metals in contact with aqueous systems in which solids tend to concentrate.

It is a further object of this invention to provide corrosion inhibition at very low dosages of inhibitor.

DETAILED DESCRIPTION OF THE INVENTION

According to the present invention, it has been surprisingly found that improved corrosion inhibition can be achieved by the use of a specific composition. This composition is the combination of hydroxyphosphonoacetic acid or a water-soluble salt thereof (HPAA compounds) and certain organic copolymers as described in detail herein below. It has been found that the subject combination of components results in a desired effect.

Accordingly, the present invention provides a process of inhibiting corrosion of iron base metals (i.e. ferrous metals) in contact with an aqueous system by incorporating into the aqueous system a water-soluble compound having the formula:

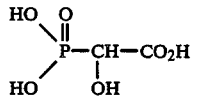

or a water-soluble salt thereof. Suitable salts include those of alkali metals, alkaline earth metals, ammonia, or an alkylamine (optionally substituted with one to six hydroxyl groups) containing 1 to 20, preferably 1 to 12, carbon atoms. Examples of suitable salts are those of lithium, sodium, potassium, calcium, strontium, magnesium, ammonia, methylamine, ethylamine, n-propylamine, trimethylamine, triethylamine, n-butylamine, n-hexylamine, octylamine, ethanolamine, diethanolamine, and triethanolamine. The acid itself, its ammonium salts, and its alkali metal salts are preferred. Hydroxyphosphonoacetic acid and its water-soluble salts will be referred to throughout this specification as HPAA compounds.

The copolymeric material required to be used in combination with the HPAA compounds can be represented by the general formula:

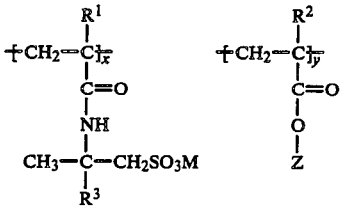

wherein $R^1$ and $R^2$ each independently represent hydrogen or methyl; $R^3$ represents hydrogen or $C_1$–$C_{12}$ straight or branch chain alkyl group, preferably a $C_1$ to $C_3$ alkyl group, or a cycloalkyl group having up to six carbon atoms or a phenyl group; M represents hydrogen or an alkali metal cation or alkaline earth metal cation or an ammonium cation or mixtures thereof selected from metal or ammonium cations which present no adverse effect to the polymer solubility in water, the preferred cations are selected from alkali metals, and ammonium cations with sodium, potassium and ammonium being most preferred; Z represents hydrogen or alkali metal or ammonium cation or mixtures thereof; x and y are integers such that the ratio of x to y is from about 5:1 to 1:5 and the sum of x+y is such that the copolymer has a weight average molecular weight of between 1,000 and 100,000 and more preferably between 1,000 and 10,000 and most preferably between about 4,000 and about 6,000.

The preferred copolymers are formed from acrylic acid or methacrylic acid or their alkali metal salts in combination with 1-acrylamido-2-methylpropane sulfonic acid or its alkali metal or ammonium salts. The copolymers can be partially or completely neutralized as the salt. The molar ratio of the monomeric material is from about 5:1 to about 1:5 and preferably from about 2:1 to about 1:2.

The copolymer required for use in the composition of the subject invention may contain minor amounts of up to about 5 mole percent of other monomeric units which are inert with respect to the subject process such as lower ($C_1$–$C_3$) esters of acrylic or methacrylic acid, acrylonitrile and the like.

The copolymer required for forming the composition found useful in performing the subject process can be formed by conventional vinyl polymerization techniques. The monomers of 2-acrylamido-2-methylpropane sulfonic acid, methacrylic acid and acrylic acid (as appropriate) are each commercially available. The monomers are mixed in appropriate molar ratios to form the desired product and are polymerized using conventional redox or free radical initiators. Formation of low molecular weight copolymers may require the presence of chain terminators such as alcohols and the like in manners known in the art.

In general, the weight ratio of HPAA compound to copolymer should fall within the range of about 1000:1 to about 1:10. Preferably, the weight ratio of HPAA compound to polymer is about 1:5 or more; more preferably at least about 1:1. Likewise, the preferred weight ratio of copolymer to HPAA compound is about 1:20 or more; more preferably at least about 1:5. Most preferably, the weight ratio of HPAA compound to copolymer is about 2:1.

The dosage of the composition of the present invention depends, to some extent, on the nature of the aqueous system in which it is to be incorporated and the degree of protection desired. In general, however, it can be said the concentration in the aqueous system can be from about 0.5 to about 10,000 ppm. Within this range, generally low dosages of from about 1 to about 100 ppm are normally sufficient, and even a comparatively low dosage of from about 5 to about 15 ppm substantially inhibits corrosion in aqueous systems such as cooling water systems. The exact amount required with respect to a particular aqueous system can be readily determined in conventional manners.

The composition may be added to the aqueous system coming in contact with the metal surfaces of an apparatus by any convenient mode, such as by first forming a concentrated solution of the composition with water (preferably containing between 1 and 50 total weight percent of the copolymer and HPAA compound) and then feeding the concentrated solution to the aqueous system at some convenient point in the system. Alternately, the above-described HPAA compound and copolymer can be each separately added directly to the aqueous system to allow the formation of the subject composition to form in situ in the aqueous system. It is believed, although not made a limitation of the instant invention, that the copolymer and HPAA compound interact to attain the achieved corrosion inhibition which results are not attainable by use of each of the individual components.

The corrosion inhibition achieved by this invention is particularly suited for cooling water systems and the like in which the system water is substantially free of chromate. The corrosion inhibiting combination can be used effectively without the presence of any or all of polyphosphate, nitrate, nitrite, borate or other ferrous metal corrosion inhibitors such as zinc. The combination will also function without phosphate and thus should reduce reliance upon phosphate as a corrosion inhibiting agent as well. However, it should be anticipated that the HPAA may, like phosphonates in general, eventually degrade, releasing phosphate at a rate dependent upon the conditions and chemistry of the system.

It will be appreciated, however, that other ingredients customarily employed in aqueous systems of the type treated herein can be used in addition to the subject composition. Such water treatment additives are, for example, biocides, lignin derivatives, yellow metal corrosion inhibitors (eg. benzotriazole), and the like.

Practice of the invention will become further apparent from the following non-limiting example.

EXAMPLE I

Hydroxyphosphonoacetic acid (as the acid) was obtained from Ciba-Geiga of Ardsley, N.Y.; and a copolymer of 2-acrylamido-2-methylpropane sulfonic acid and methacrylic acid (1:2) (as the potassium salt) was obtained from Dearborn Division, W. R. Grace & Co. of Lake Zurich, Ill. The copolymer had a molecular weight of approximately 6,000.

Test water solutions containing 12.5 ppm calcium chloride, 30.2 ppm calcium sulfate hemihydrate, 110.8 ppm magnesium sulfate heptahydrate and 176.2 ppm sodium bicarbonate were prepared to simulate a softened Chicago tap water. The solutions had a calcium hardness of approximately 80 ppm as calcium carbonate and were free of chromate, phosphate, polyphosphate, nitrite, nitrate, and borate.

The test solution was added to a cooling water test rig having an 8.7 liter system volume. The rig included a main test tank and a recirculation line. The pH was adjusted to about 8.0 to 8.5 using dilute sulfuric acid. Two clean, preweighed SAE 1010 mild steel coupons (approximately 4.5×0.5×0.05 inches) were immersed in the recirculation line and another two like coupons were immersed in the tank. The water was heated to approximately 130° F. while pH was controlled from 8.0 to 8.5. Water circulation in the rig was begun. The recirculation flow produced a water velocity of approximately 2 ft/sec past the coupon in the recirculation line while the water in the tank was substantially quiescent. Make-up water was added at a rate of approximately 11 ml/min and system water was bled off at an equivalent rate of approximately 11 ml/min. The run was continued for about 3 days, after which the coupons were removed from the rig and cleaned. Corrosion of the coupons was measured by reweighing the coupons to determine weight loss. A corrosion rate in mils (thousandths of an inch) per year was then calculated.

The run was repeated, this time adding an initial dosage of approximately 45 ppm of the hydroxyphosphonoacetic acid. The make-up water contained a maintenance dosage of approximately 15 ppm hydroxyphosphonoacetic acid.

A third run was made for comparative purposes using an initial concentration of approximately 45 ppm of the copolymer. A maintenance dosage of approximately 15 ppm of the copolymer was present in the make-up water.

A fourth run was made to show the value of combining the HPAA compound with the copolymers in accordance with this invention. In this run, the system had an initial concentration of approximately 30 ppm of the hydroxyphosphonoacetic acid and approximately 15 ppm of the copolymer. Concentrations of approximately 10 ppm of the HPAA and 5 ppm of the copolymer were maintained in the make-up water.

The results of the four runs are summarized in Table I.

TABLE I

| Maintenance Dosage | | Corrosion Rate (mils/yr) | |
|---|---|---|---|
| Hydroxyphosphono-Acetic Acid | Copolymer | Recirculation Line | Tank |
| 0 ppm | 0 ppm | 30.8 | 34.3 |
| 15 ppm | 0 ppm | 6.4 | 14.8 |
| 0 ppm | 15 ppm | 235.3 | 54.2 |
| 10 ppm | 5 ppm | 3.1 | 11.7 |

The results confirm that hydroxyphosphonacetic acid has a fair degree of corrosion inhibiting effect in cooling water, even at these lower dosages. In contrast, it is evident from the tests that the copolymer by itself was ineffective as a corrosion inhibitor in the cooling water conditions simulated by the test.

With particular regard to the invention described herein, it is also evident from the results above that the combination of HPAA compound with copolymer surprisingly provides a substantial corrosion inhibiting effect. The improved corrosion protection is readily apparent. It is also apparent that use of the copolymer in accordance with this invention allows a substantial reduction in the amount of hydroxyphosphonoacetic acid required to achieve equivalent protection. Indeed, the example illustrates that the advantages of lower HPAA use and improved corrosion protection can both be simultaneously realized by certain corrosion inhibiting applications of this invention.

The example describes particular embodiments of the invention. Other embodiments will become apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the following claims.

What is claimed is:

1. A composition suitable for inhibiting the corrosion of an iron based metal in contact with the system water in an aqueous system comprising a combination of
   (a) hydroxyphosphonoacetic acid or a water-soluble salt thereof; and in a weight ratio to component
   (a) between about 10:1 and about 1:1000,
   (b) a copolymer having the general formula:

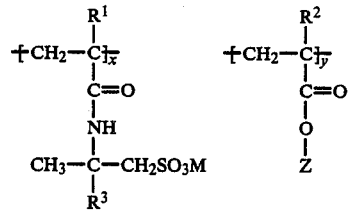

wherein $R^1$ and $R^2$ each independently represent hydrogen or methyl; $R^3$ represents hydrogen or $C_1$–$C_{12}$ straight or branch chain alkyl group, or a cycloalkyl group having up to six carbon atoms or a phenyl group; each M, which may be the same or different, represents hydrogen or an alkali metal cation or ½ an alkaline earth metal cation or an ammonium cation; each Z, which may be the same or different, represents hydrogen or an alkali metal or ammonium cation; x and y are integers such that the ratio of x to y is from 5:1 to 1:5 and the sum of x+y is such that the copolymer has a weight average molecular weight of 1,000 to 100,000.

2. A composition according to claim 1 wherein the water-soluble hydroxyphosphonoacetic acid compound is hydroxyphosphonoacetic acid, an ammonium salt thereof, or an alkali metal salt thereof.

3. A composition according to claim 2 wherein the copolymer is formed from 2-acrylamido-2-methylpropane sulfonic acid and acrylic acid or methacrylic acid, said copolymer-forming acids being in the form of free acids or at least partially neutralized with an alkali metal cation or an ammonium cation.

4. A composition according to claim 3 wherein the copolymer has a weight average molecular weight of from 1,000 to 10,000; the ratio of x to y is from 2:1 to 1:2; and the weight ratio of (a) to (b) is between about 20:1 and 1:5.

5. A composition according to claim 1 wherein $R^1$ is hydrogen, $R^2$ is methyl, $R^3$ is hydrogen or a $C_1$–$C_3$ alkyl and M is hydrogen, an alkali metal cation or an ammonium cation.

6. A composition according to claim 1 wherein the copolymer is formed from 2-acrylamido-2-methylpropane sulfonic acid and methacrylic acid.

7. A composition according to claim 1 wherein the copolymer has a weight average molecular weight of from about 4,000 to about 6,000; the ratio of x to y is 2:1 to 1:2; and the weight ratio of (a) to (b) is between about 5:1 and 1:1.

8. The composition of claim 7 wherein the copolymer is formed from 2-acrylamido-2-methylpropane sulfonic acid and methacrylic acid, or alkali metal or ammonium salts thereof; and wherein the water-soluble hydroxyphosphonoacetic acid compound is hydroxyphosphonoacetic acid, an ammonium salt thereof, or an alkali metal salt thereof.

9. A process for inhibiting corrosion of an iron based metal in contact with the system water in an aqueous system comprising incorporating into the aqueous system an effective amount of a corrosion inhibiting mixture comprising (a) hydroxyphosphonoacetic acid or a water-soluble salt thereof; and, in a weight ratio to component (a) between about 10:1 and about 1:1000, (b) a copolymer having the general formula:

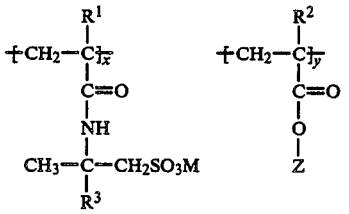

wherein $R^1$ and $R^2$ each independently represent hydrogen or methyl; $R^3$ represents hydrogen or $C_1$–$C_{12}$ straight or branch chain alkyl group, or a cycloalkyl group having up to six carbon atoms or a phenyl group; each M, which may be the same or different, represents hydrogen or an alkali metal cation or ½ an alkaline earth metal cation or an ammonium cation; each Z, which may be the same or different, represents hydrogen or an alkali metal or ammonium cation; x and y are integers such that the ratio of x to y is from 5:1 to 1:5 and the sum of x+y is such that the copolymer has a weight average molecular weight of 1,000 to 100,000.

10. A process according to claim 9 wherein the water-soluble hydroxyphosphonoacetic acid compound is hydroxyphosphonoacetic acid, an ammonium salt thereof, or an alkali metal salt thereof.

11. A process according to claim 10 wherein the copolymer has a weight average molecular weight of from about 4,000 to about 6,000; the ratio of x to y is from 2:1 to 1:2; and the weight ratio of (a) to (b) is from about 20:1 to about 1:5.

12. A process according to claim 10 wherein $R^1$ is hydrogen, $R^2$ is methyl, $R^3$ is hydrogen or a $C_1$–$C_3$ alkyl and M is hydrogen, an alkali metal cation or an ammonium cation.

13. A process according to claim 9 wherein the aqueous system is a cooling water system.

14. A process according to claim 9 wherein the system water is substantially chromate-free.

15. A process according to claim 9 wherein the copolymer is formed from 2-acrylamido-2-methylpropane sulfonic acid and acrylic acid or methacrylic acid, said copolymer-forming acids being in the form of free acids or at least partially neutralized with an alkali metal cation or an ammonium cation.

16. A process according to claim 15 wherein the copolymer is formed from 2-acrylamido-2-methylpropane sulfonic acid and methacrylic acid.

17. A process according to claim 15 wherein the copolymer has a weight average molecular weight of from 1,000 to 10,000; and the weight ratio of (a) to (b) is 20:1 to 1:1.

18. A process according to claim 17 wherein the system water is substantially chromate-free.

19. A process according to claim 18 wherein the copolymer has a molecular wieght of from about 4,000 to 6,000 and is formed from 2-acrylamido-2-methylpropane sulfonic acid and methacrylic acid, or alkali metal or ammonium salts thereof; wherein the ratio of x to y is between about 2:1 and 1:2; and wherein the hydroxyphosphonoacetic acid compound is hydroxyphosphonoacetic acid, an ammonium salt thereof, or an alkali metal salt thereof.

20. A process according to claim 19 wherein the aqueous system is a cooling water system.

* * * * *